US005213520A

United States Patent [19]

Casey et al.

[11] Patent Number: 5,213,520

[45] Date of Patent: May 25, 1993

[54] FIREWALL CONNECTOR

[75] Inventors: Daniel T. Casey, Harrisburg; William T. Glenwright, York, both of Pa.

[73] Assignee: AMP Incorporated, Harrisburg, Pa.

[21] Appl. No.: 855,616

[22] Filed: Mar. 20, 1992

Related U.S. Application Data

[63] Continuation-in-part of Ser. No. 840,202, Mar. 2, 1990, abandoned, and a continuation-in-part of Ser. No. 840,201, Mar. 2, 1990.

[51] Int. Cl.[5] ..... H01R 13/52; H01R 9/24; H01R 13/74

[52] U.S. Cl. ..... 439/559; 439/564; 439/712; 439/587; 174/77 R

[58] Field of Search ..... 174/77 R, 84 S, 93, 174/48; 439/709, 564–566, 712, 722, 724, 556, 559, 587, 589

[56] References Cited

U.S. PATENT DOCUMENTS

| | | | |
|---|---|---|---|
| 2,750,436 | 6/1956 | Richter | 174/77 R |
| 3,655,907 | 4/1972 | Philibert et al. | 174/77 R |
| 3,955,044 | 5/1976 | Hoffman et al. | 174/84 C |
| 3,995,102 | 11/1976 | Kohaut | 174/48 |
| 4,099,202 | 7/1978 | Kohaut | 174/48 |
| 4,336,416 | 6/1982 | Goodsell | 174/48 |
| 4,439,965 | 4/1984 | Langenhorst | 52/211 |
| 4,464,006 | 8/1984 | Wilt | 439/544 |
| 4,770,643 | 9/1988 | Castellani et al. | 439/135 |
| 5,032,690 | 7/1991 | Bloom | 174/48 |

OTHER PUBLICATIONS

Product of Flight Corp., Selelock Connector.

Product of ITT Cannon Corp., Part No. 8848-14 FRF6E36-5301; Fountain View, Calif.

*Primary Examiner*—Gary F. Paumen

*Attorney, Agent, or Firm*—Anton P. Ness

[57] ABSTRACT

A bulkhead connector includes an array of bus bars extending from a first face to a second face for interconnecting associated power cables on opposing sides of the bulkhead, and is also suited for bulkhead openings of the type having a cylindrical sleeve extending therearound outwardly from the bulkhead. Contained between a pair of metal plates and within a cylindrical sleeve is an elastomeric member through which the bus bars extend, the elastomeric member being compressed within the sleeve upon said first and second metal plates being tightly drawn toward each other by a stud assembly. The metal plates and elastomeric member provide fire resistant material extending transversely completely across the bulkhead opening, with apertures through which extend the bus bars. Exposed contact sections of the bus bars permit terminals to be fastened thereto, and the connector is adapted to prevent rotation of the fastened terminals during in-service use.

14 Claims, 9 Drawing Sheets

FIREWALL CONNECTOR

RELATED APPLICATION INFORMATION

This is a Continuation-in-Part of U.S. patent application Ser. No. 07/840 of U.S patent application Ser. No. 07/840,201 both filed Mar. 2, 1992.

FIELD OF THE INVENTION

This relates to the field of electrical connectors and more particularly to bulkhead connectors for interconnecting power cables in high temperature environments.

BACKGROUND OF THE INVENTION

Electrical power cables conventionally extend from generators powered by engines of jet aircraft to the main frame of the aircraft through the wing structure, extending through openings in the bulkheads adjacent the engines and generators. Such power cables transmit a current of up to 360 amperes at 115 volts, and have been continuous from the generator to the fuselage wall; in such arrangements, the entire cable length must be replaced when repair is needed, necessitating the tedious time-consuming unfastening of the cable from holders closely spaced along its length. The bulkhead is of rugged durable metal sufficient to withstand the very high temperatures associated with the jet engine vicinity; such temperatures may reach up to 550° F. In the case of a calamity, the bulkhead is also able to resist fire burnthrough should fire occur in the engine vicinity, providing a substantial safety benefit for the aircraft for a period of time. The cable openings through the bulkhead have conventionally been filled by fire-resistant rubber compressed within a cylindrical metal flange extending perpendicularly from the bulkhead, about the cables between steel plates joined by a stud, providing a complete barrier after the cables have been extended through the opening and along the wing to the fuselage. There is also known a connector mounted to a bulkhead and containing terminals to which cables are terminated, which is matable to a complementary connector, in which the terminals include conventional pin and socket contact sections at the mating interface.

It is desired to provide an arrangement whereby instead of use of a continuous cable, a pair of cable lengths is utilized having terminals on adjacent ends to be interconnected proximate the generator.

It is desired to provide an electrical connector providing for an electrical interconnection of the terminals which is disconnectable if desired. It is known in general to provide a post onto which terminals having ring-shaped contact sections both are placed and pressed together to define a compression fit suitable to define an assured electrical connection therebetween for transmitting power levels of current along the cable pair.

It is desired to provide such an electrical connector which is adapted for high temperature environments and is also adapted to provide for the substantial levels of compression of a ring-shaped contact section of a cable terminal to an interconnection bus.

It is further desired to provide such a connector which is mountable within the opening of a bulkhead.

It is additionally desired to provide such an electrical connector which is capable of withstanding flame burnthrough of the bulkhead opening within which it is mounted.

SUMMARY OF THE INVENTION

The present invention is a connector defining an impervious flame barrier and is mountable to a bulkhead opening of the type having a cylindrical flange joined to the bulkhead around the opening. The connector includes a plurality of bus bars extending through a housing assembly from first ends at a first mating face proximate the generator and engine on one side of the bulkhead, to second ends at a second mating face proximate the main frame or fuselage of the aircraft on the other side of the bulkhead. The first and second bus bar ends are adapted to have ringtongue terminals of the power cables secured thereto by bolts extending through bus bar end apertures and threadedly received into female inserts contained within the connector housing beneath the exposed bus bar ends.

The housing assembly of the present invention includes a body molded from elastomeric material having high temperature resistance and in one embodiment is molded as a discrete part including openings through which extend the bus bars; in another embodiment the elastomeric housing component may be molded around the bus bars. First and second metal plates are secured to respective ends of the elastomeric housing and are drawn together by a stud assembly upon mounting of the connector, to compress the elastomeric material to seal all openings around the bus bars, the stud and the bulkhead flange, with one of the metal plates mounted to the bulkhead such as by bolts and nuts.

A first housing member is bolted to the first end of the connector outwardly of the first metal plate providing barrier walls individually insulating the first bus bar ends and the ring terminals bolted thereto. The first housing member may be secured to the end of stud by a nut after mounting the connector to the bulkhead and compressing the elastomeric housing body. Preferably the first bus bar ends are fastened to the ring terminals each by two bolts through two apertures of the first contact section, protecting against rotation of the terminals fastened thereto which would otherwise loosen the electrical connection.

The connector also provides a second housing member at the second end of the connector outwardly of the metal plate at that end, having channels within which the second ends of the bus bars are disposed for the second contact sections to be bolted to ring terminals of cables. The second housing member may be secured to the second metal plate by nuts threaded onto second threaded ends of the fasteners used to secure the second plate to the bulkhead. The housing member includes female inserts within the connector housing in pockets beneath and adjacent the second contact sections of the bus bars, having threaded openings aligned with bolt-receiving apertures of the contact sections, enabling bolts to be threaded thereinto for electrically connecting ring-tongue terminals of the power cables to the contact sections under appropriate compressive force. The channel side walls prevent rotation of the terminals after being fastened to the bus bar contact sections.

In another embodiment, the connector provides for an array of bus bars parallel to each other and oriented with their contact sections facing upwardly or downwardly rather than in four distinct directions simplifying terminal connecting thereto. Sufficient dielectric material is provided between the bus bars at their closest portions within the housing. The connector also provides an adapter sleeve surrounding the elastomeric housing which enables the connector to be mounted at a bulkhead cutout of appropriate diameter not otherwise having an existing annular sleeve, with an annular flange of the adapter sleeve held abutting the periphery of the bulkhead cutout within a recess of the metal plate mounted to the bulkhead. The connector also is adapted to permit right angle terminal fastening in either direction, and further includes housing structure adjacent the bus bar contact sections which physically prevents cables designed for power levels higher than that for which the connector is designed, from being fastened to the contact sections by blocking the cable's corresponding large terminals from being superposed over the contact sections.

In yet another embodiment, the connector housing may comprise a single elastomeric molded member securable between a pair of metal plates. Slotted apertures extend therethrough to receive tongues or blades of ring terminals which are fabricated with elongated tongues or blades, to extend completely through the apertures of the first metal plate, through the housing and outwardly of the second metal plate at the second end which is mounted to the bulkhead. A stud is tightened to draw the first metal plate toward the second metal plate, compressing the elastomeric material about the terminal tongues and outwardly against the cylindrical flange of the bulkhead.

It is an objective of the present invention to provide a connector for retrofitting, with minimal rework, existing bulkhead openings of the type having a cylindrical flange therearound extending outwardly of the bulkhead, where the cables previously extending therethrough are removed therefrom, enabling cable ends to be mounted to power bus means therethrough and disconnectable therefrom on at least one side of the bulkhead.

It is similarly an objective to provide a connector for bulkhead openings not having a cylindrical flange already in place thereat, so that the connectors of the present invention is adapted to retrofit a variety of bulkhead arrangements.

It is also an objective for such a connector to be resistant to fire, high in-service temperatures and high vibration.

It is a further objective to provide a connector adapted for ring terminal fastening in a manner preventing rotation of the terminal after mounting when the cables are subjected to torque and stress.

It is an additional objective to provide such a connector adapted for in-line cable attachment and eitherside right angle cable attachment.

It is yet another objective to provide such a connector which is adapted to prevent fastening thereto of cables of current-carrying capability higher than the design capability of the connector.

The present invention will now be described by way of example with reference to the accompanying drawings.

DETAILED DESCRIPTION OF THE PREFERRED EMBODIMENT

Figure 1:
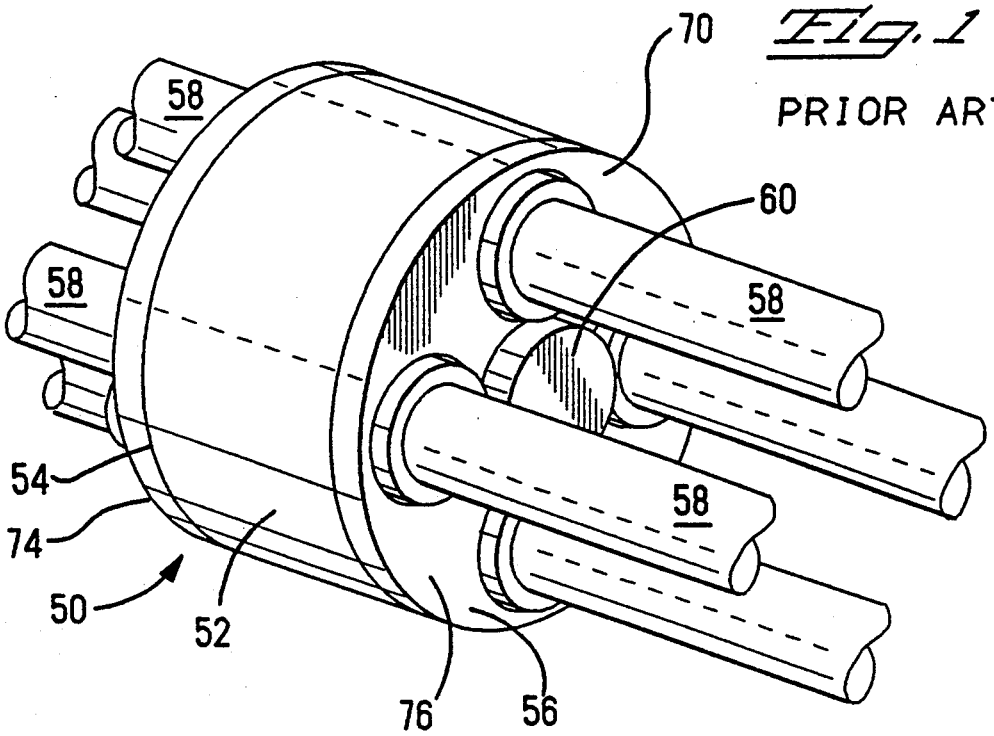
Fig. 1 PRIOR ART
FIGS. 1 to 4 are isometric and section views of a PRIOR ART bulkhead opening having continuous lengths of power cables extending through an elastomeric gasket within a flange and between steel plates drawn together using a stud, with the gasket shown compressed about the cables and against the flange in FIG. 4.
Figure 2:
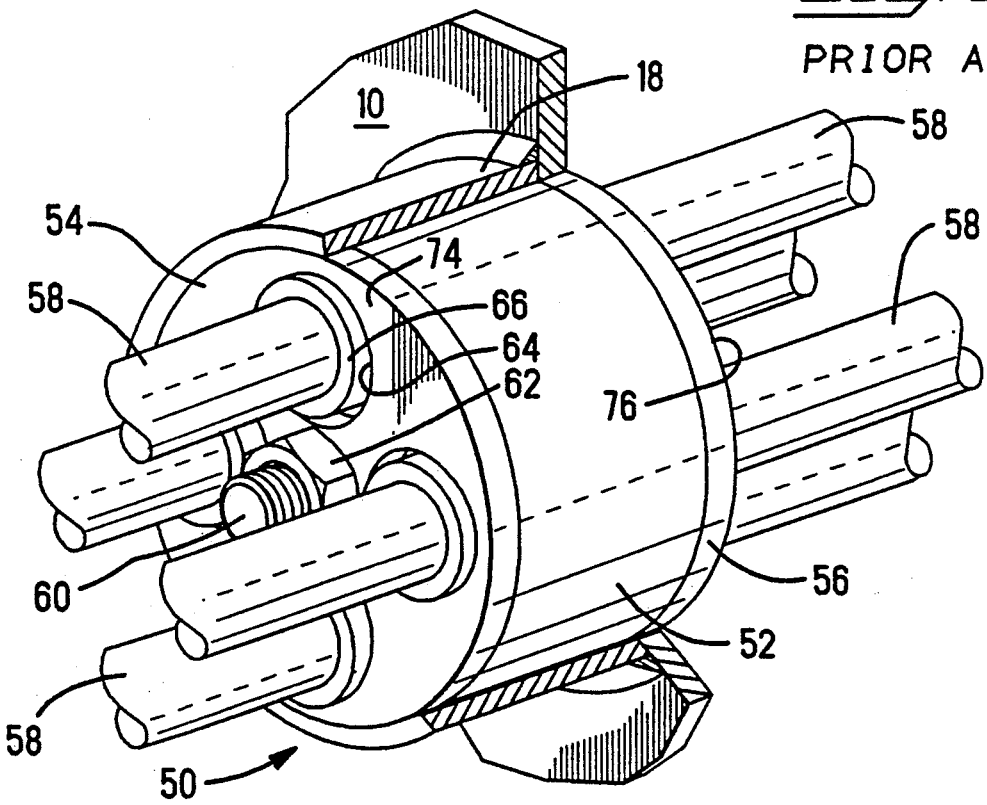
Fig. 2 PRIOR ART

The PRIOR ART arrangement 50 is shown in FIGS. 1 to 4 wherein an elastomeric grommet 52 is fastened between first and second circular metal plates 54,56, for passage of cables 58 through openings in the grommet 52 and plates 54,56. Elastomeric grommet 52 is made of especially heat and flame resistant material such as fluorosilicone elastomer. A stud and nut assembly 60,62 secures plates 54,56 to first and second ends of the grommet enabling the plates to be drawn together to compress the elastomeric grommet tightly therebetween. Annular flanges 64,68 extend outwardly from ends of grommet 52 through openings 66,70 in the metal plates and around the cables 58. For consistency between the Figures, the ship side of the bulkhead is to the left side of each Figure, and the engine side of the bulkhead is to the right side.

Figure 3:
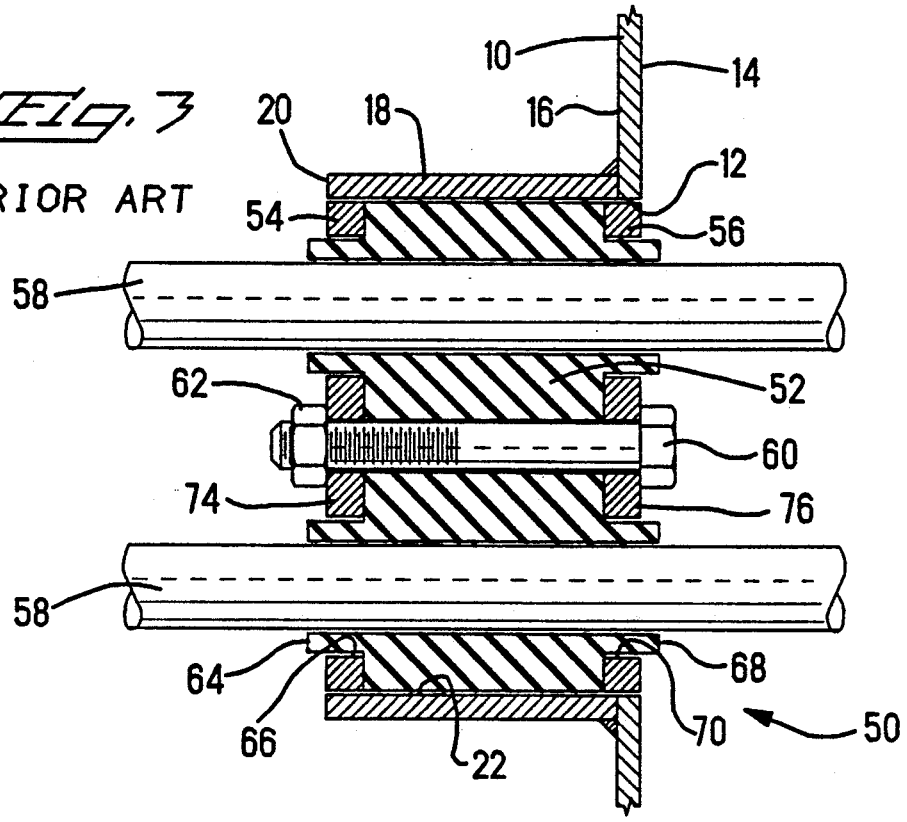
Fig. 3 PRIOR ART
Figure 4:
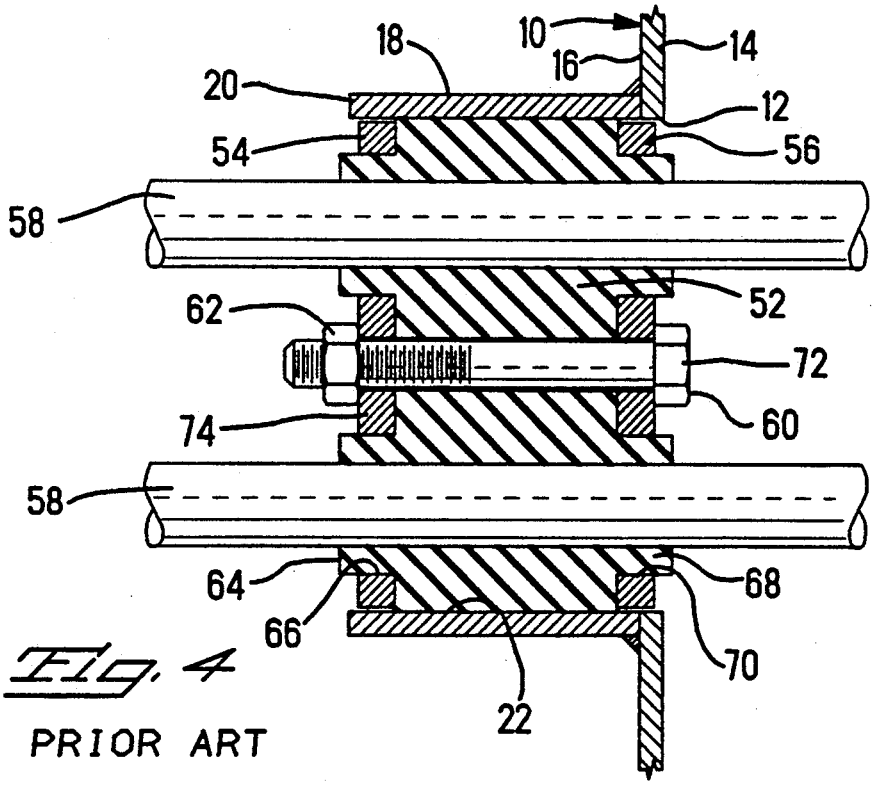
Fig. 4 PRIOR ART
Figure 5:
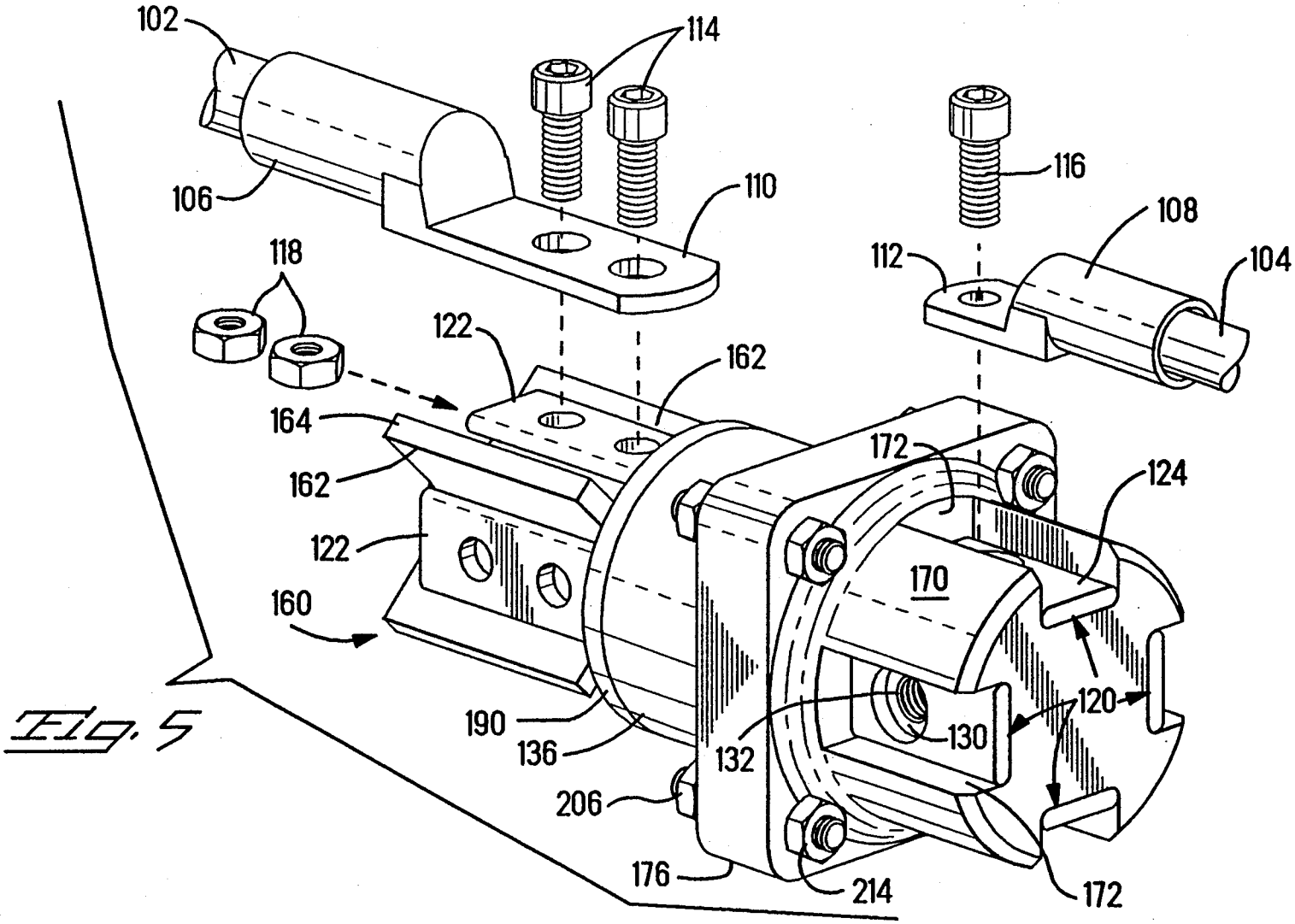
FIGS. 5 and 6 are isometric and section views respectively of a first embodiment of the present invention assembled to a bulkhead through a flanged opening, with terminated power cables fastened to selected bus bar contact sections in FIG. 5.

Assembly 50 is utilized with respect to a bulkhead 10 in FIGS. 3 and 4 such as of an aircraft having an opening 12 extending therethrough from a first or engine side 14 to a second or ship side 16. A cylindrical flange 18 is welded to bulkhead 10 and extends outwardly from ship side surface 16 thereof to an end 20. First metal plate 54 is axially positioned at and within end 20 of flange 18 while second plate 56 is positioned directly at and within bulkhead opening 12, by sliding assembly 50 along cables 58 until properly positioned. As nut 62 is tightened onto stud 60, head 72 of stud 60 against the engine side surface 76 of plate 56 and nut 62 against the ship side surface 74 of plate 54 draw the plates tightly toward each and against the grommet 52 compressing the elastomeric material. As shown in FIG. 4, the elastomeric material is deformed radially outwardly against the inside surface 22 of flange 18 and axially outwardly through plate openings 66,70 and against the insulative jacket of cables 58 thus sealing all gaps and openings to provide resistance to flames which may arise on the engine side in the event of a calamity, protecting the ship side for a length of time.

Connector 100 of the present invention is shown in FIGS. 5 to 9, and defines a system for electrically connecting ends of associated power cables 102,104 (associated with each side 14,16 respectively of bulkhead 10) which have terminals 106,108 terminated on the conductors thereof respectively. An array of bus bar members 120 extend through connector 100 and have first and second contact sections 122,124 at respective ends 126,128 for connection to terminals 106,108. Blades or tongues 110,112 of terminals 106,108 include holes for bolts 114,116 to be inserted therethrough to be secured to contact sections 122,124 either in cooperation with nuts 118 or female inserts 130. Tongues 110 and first contact sections 122 along first housing 160 include a pair of holes for a pair of bolts 114 and nuts 118 to secure terminals 106 to bus bars 120 at two locations, preventing rotation of terminals 106 after fastening when cables 102 are subjected to torque and stress which otherwise would undesirably tend to loosen the electrical connection. Female inserts 130 associated with second contact sections 124 have a single threaded aperture 132 for a single bolt 116; however female inserts 130 prevented from rotating by being embedded in second housing member 170 beneath second contact sections 124, which are disposed in channels 172.

First housing member 160 includes barrier walls 162 extending radially outwardly between first contact sections 122, creating necessary insulative material therebetween to assure electrical isolation axially along the first ends of bus bars 120 and terminals 106, outwardly of first metal plate 190. First contact sections 122 are thus disposed in channels 164 which will contain nuts 118 after fastening of terminals 106.

Figure 6:
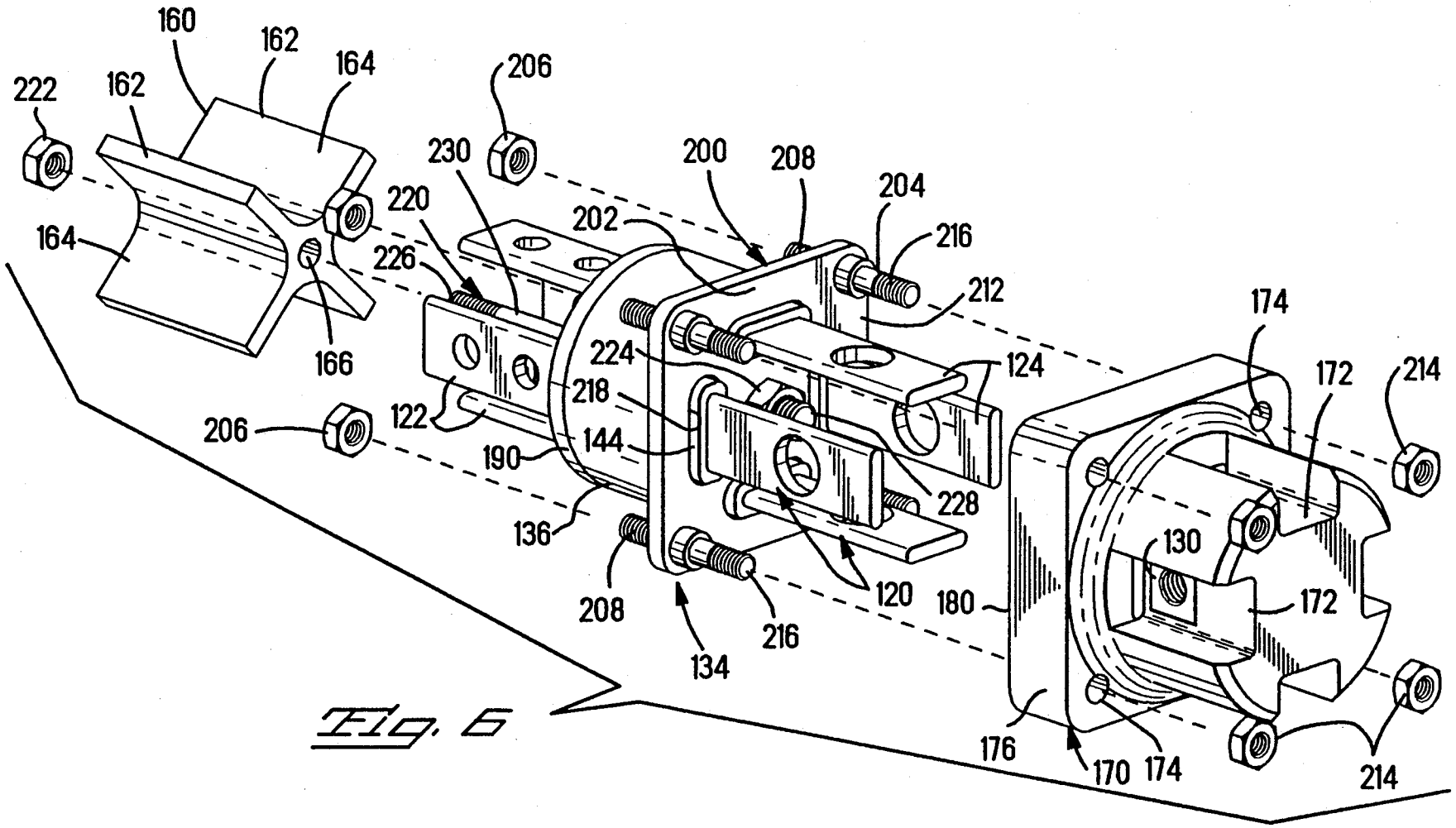

Referring to FIG. 6, first and second housings 160,170 are separate dielectric members formed of high temperature resistant plastic such as thermoset polyester and are secured to engine side and ship side ends of a connector subassembly 134. Connector subassembly 134 includes an elastomeric body member 136 disposed between first plate 190 and second plate 200 which are secured to each other by a stud 220 and pair of nuts 222,224 secured to opposed threaded ends 226,228 of elongated stud shank 230. First housing member 160 includes a stud-receiving aperture 166 therethrough for threaded first end 226 to extend outwardly thereof. Bus bars 120 extend through connector subassembly 134 for first contact sections 122 to be disposed in channels 164 of first housing member 160, and second contact sections 124 to be received into and through second housing member 170.

Second metal plate 200 includes a mounting flange 202 shaped and dimensioned to extend radially beyond the envelope of the bulkhead opening and includes mounting bolts 204 extending therethrough enabling mounting to the bulkhead in cooperation with nuts 206 securable on first threaded end 208 which will extend from ship side surface 210 of second plate 200 through mounting holes of the bulkhead. Second housing member 170 is mountable along engine side surface 212 of second plate 200 in cooperation with nuts 214 securable on second threaded ends 216 which are received through mounting holes 174 of mounting flange 176. Preferably mounting bolts 204 include shoulders 218 which are received into recesses 178 about mounting holes 174 along engine side surface 180 of second housing member 170 (see FIG. 7). Second housing member 170 further includes a large recess 182 to receive second threaded end 228 and nut 224 thereinto upon full connector assembly.

Figure 7:
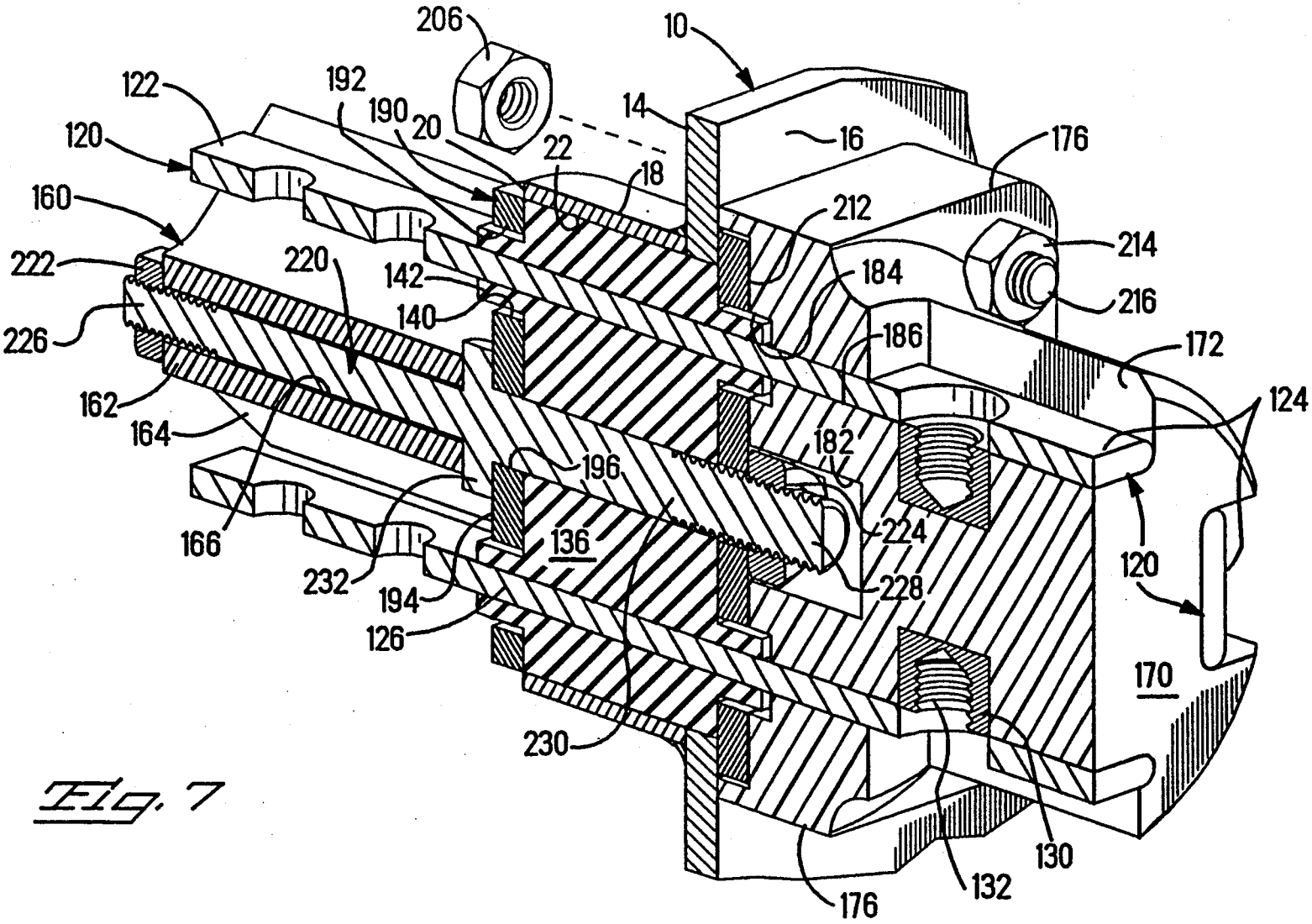
FIGS. 7 to 9 are isometric views of the connector being fabricated, with FIG. 7 showing the first and second housings exploded from the main subassembly which comprises the bus bars extending through apertures of the first and second plates and the elastomeric body, and FIGS. 8 and 9 showing the bus bars exploded from and inserted through the elastomeric body respectively.

Referring to FIG. 7, the connector can be seen in longitudinal section. Bus bars 120 extend from first contact sections 122 along channels 164 of first housing member 160 to bus bar body sections 126. Body sections 126 extend into first bar sealing flange portions 142 surrounding bar-receiving apertures 140 of elastomeric member 136 and through bar-receiving apertures 192 of first metal plate 190, through body portion 138 of elastomeric member 136, and past bar-receiving apertures 218 of second metal plate 200 through second bar sealing flange portions 144. Body sections 126 extend past recesses 184 into ship side surface 180 of second housing member 170 and through bar-receiving passageways 186 to second contact sections 124 disposed along channels 172.

Stud 220 includes a large flange 232 which abuts ship side surface 194 of first metal plate 190 as shank 230 passes into stud-receiving hole 196 through hole 146 of elastomeric member 136, to second threaded end 228 which extends through stud-receiving hole 219 of second metal plate 200. Shank 230 also extends through hole 166 of first housing member to first threaded end 226 for receipt of nut 222 thereonto.

Connector subassembly 134 is mounted to bulkhead 10 prior to mounting of second housing member 170, with elastomeric member 136 disposed in cylindrical flange 18, first metal plate 190 at and within end 20 of flange 18, and second metal plate 200 mounted to the bulkhead by bolts 204 and nuts 206. Bulkhead proximate surface 210 of second metal plate 200 at mounting flange 202 will abut bulkhead 10 upon mounting, with first ends 208 extending through mounting holes of the bulkhead for nuts 206 to be threaded thereonto. Upon connector subassembly 134 being secured to the bulkhead, stud nut 224 is rotated tightly onto second threaded end 228 of stud 220, thus drawing first plate axially toward second plate 200, compressing body portion 138 of elastomeric member 136. The elastomeric material of member 136 is deformed tightly against cylindrical flange 18, body sections 126 of bus bars 120, and first and second metal plates 190,200 assuredly closing all incremental gaps.

Second stud end 228 with nut 224 threaded thereonto is received into large recess 182 of second housing member 170 when second housing member 170 is secured to engine side surface 212 of second metal plate 200. Second contact sections 124 are received into and through bar-receiving passageways 186 of second housing member 170 and into channels 172, whereafter engine side cables are securable thereto. Second housing member 170 also preferably includes an annular flange 188 which extends past the peripheral edge of second metal plate 200 to engine side surface 16 of bulkhead 10.

Figure 8:
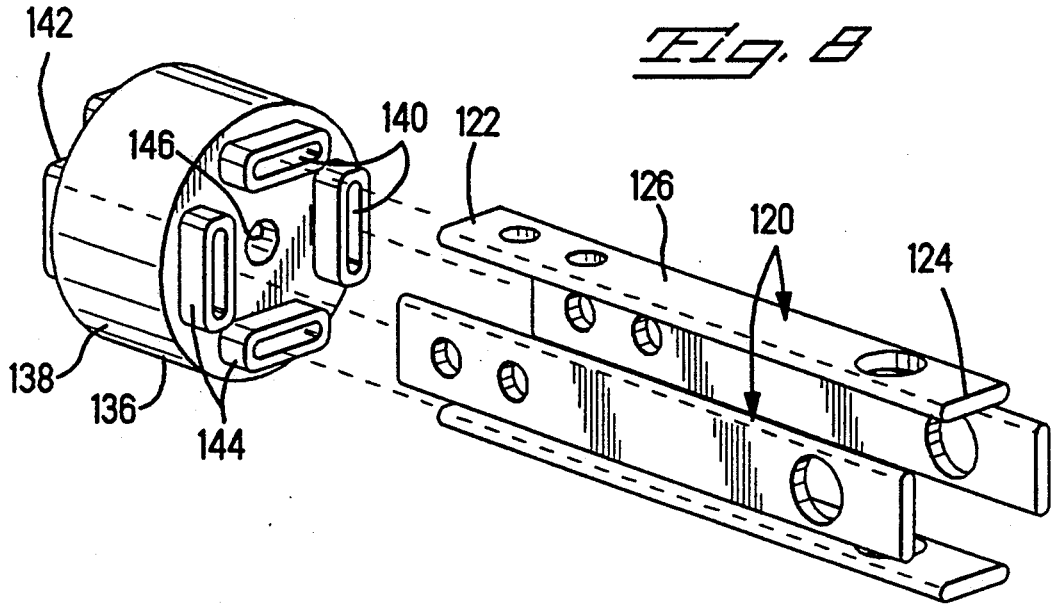
Figure 9:
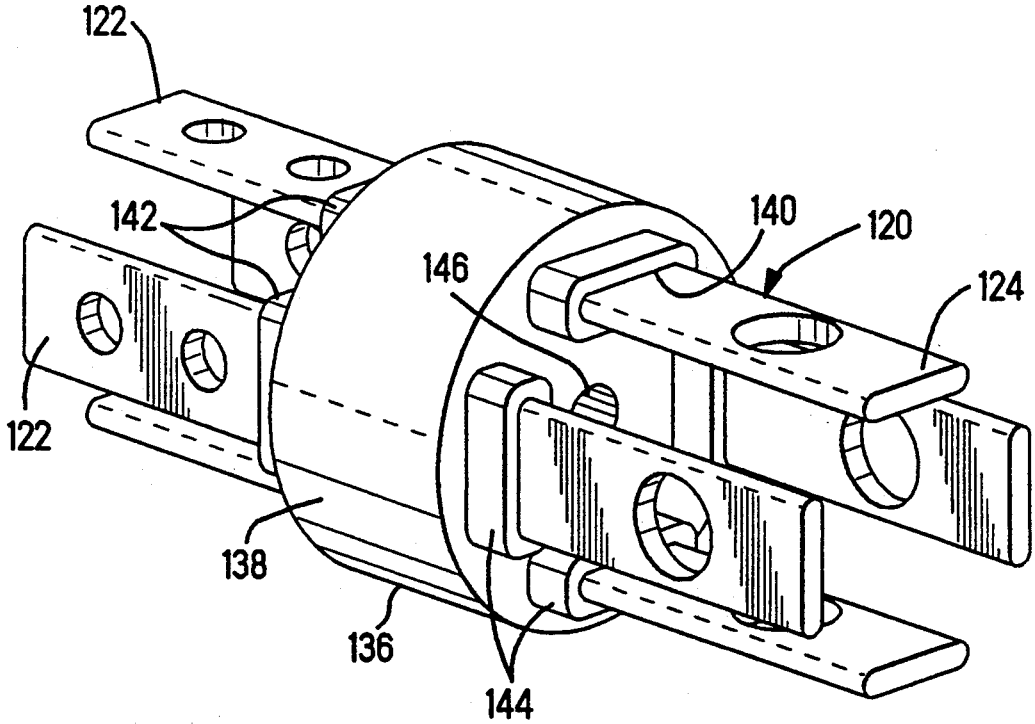

FIGS. 8 and 9 illustrate initial steps in assembling connector 100. Body sections 126 of elongate bus bars 120 have a regular rectangular cross-section therealong, and are inserted through correspondingly shaped bar-receiving apertures 140 of elastomeric member 136 which are just slightly larger than the bus bar cross-section to facilitate insertion thereinto. Optionally conventional insert molding procedures may be followed to form elastomeric member 136 directly onto body sections 126 of bus bars 120; body sections 126 of bus bars 150 could preferably include holes therethrough through which the resin would extend to provide a mechanical joint of elastomeric member 136 to bus bars 120. First housing member 160 and elastomeric member 136 are dimensioned and shaped to just fit through the bulkhead opening and within inside surface 22 of cylindrical flange 18.

Figure 10:
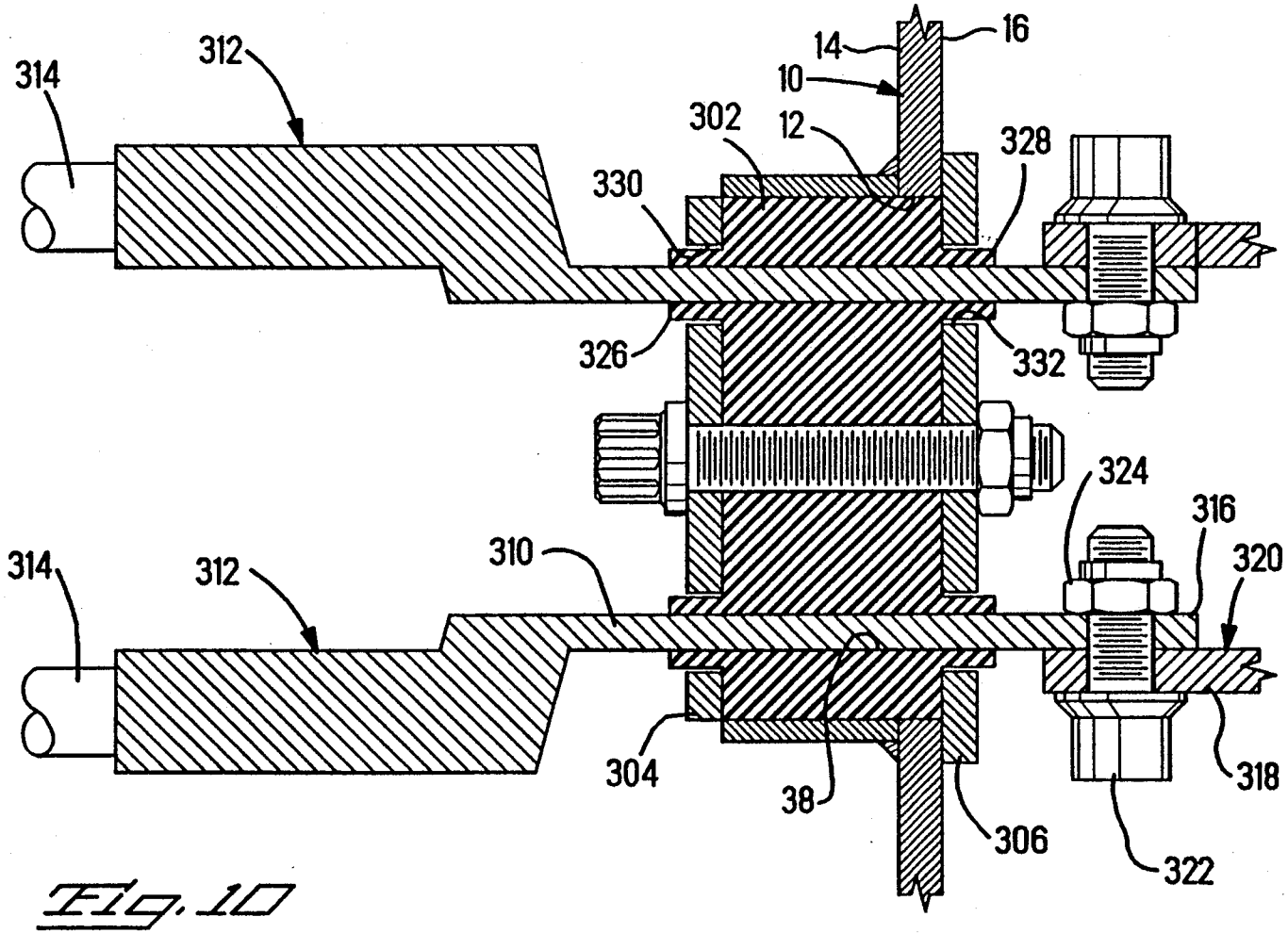
FIG. 10 illustrating an alternate embodiment of the connector of the type having elongate terminal blades of terminated cable ends on a first bulkhead side extending to the second bulkhead side through an elastomeric housing which is compressed between first and second plates and mounted to the bulkhead.

A second embodiment of connector 300 is shown in FIG. 10 wherein an elastomeric member 302 is again disposed between first and second metal plates 304,306. Apertures 308 through elastomeric member 302 receive elongate blades or tongues 310 of terminals 312 terminated to cables 314, extending therethrough from ship side 14 of bulkhead 10 to engine side 16 thereof. Contact sections 316 of terminals 312 extend from elastomeric member 302 and are exposed for corresponding contact sections 318 of ring terminals 320 to be bolted thereto by bolts 322 and nuts 324. Elastomeric member 302 preferably includes blade sealing flange portions 326,328 extending through larger dimensioned blade-receiving apertures 330,332 of first and second metal plates 304,306.

Stud 334 extends from head 336 through hole 338 of first plate 304, through hole 340 of elastomeric member 302, through hole 342 of second plate 306, and nut 344 is threaded onto threaded end 346 causing first metal plate 304 to be drawn toward second metal plate 306 compressing elastomeric member 302 to deform the elastomeric material thereof to fill all gaps as in the first embodiment of FIGS. 5 to 9 and similarly to the PRIOR ART of FIGS. 1 to 4. Second metal plate 306 includes a peripheral flange 348 which abuts bulkhead 10 providing a registration means for locating the connector prior to tightening of stud 334; after full tightening, frictional forces secure the connector within cylindrical flange 18 against movement; optionally second metal plate 306 could be mounted directly to bulkhead by bolts and nuts if desired (not shown).

Elastomeric members 136,302 are preferably molded of high temperature resistant and fire resistant material such as fluorosilicone elastomer or blends of fluoro- and other silicone elastomers. Bus bars 120 are preferably low resistance metal such as Alloy No. C-110 having high copper content. First and second metal plates 190,200;304,306 may be stainless steel. The terminal bolts or posts 114,116 and nuts 118, and mounting bolts 204 and nuts 206,214 as well as stud 220 and its associated nuts 222,224 are preferably made of high temperature stainless steel alloy such as No. A-286, and female inserts 130 may be high tensile of heat treated alloy steel nuts. Terminals 106,108 having apertured tongues are commercially available and may be for example 0-3 or 0-4 gage ring tongue terminals of Alloy No. C-110 sold by AMP Incorporated, Harrisburg, Pa. First and second connector housing members 160,170 may both be molded of high temperature resistant resin such as a thermoset polyester.

Figure 11:
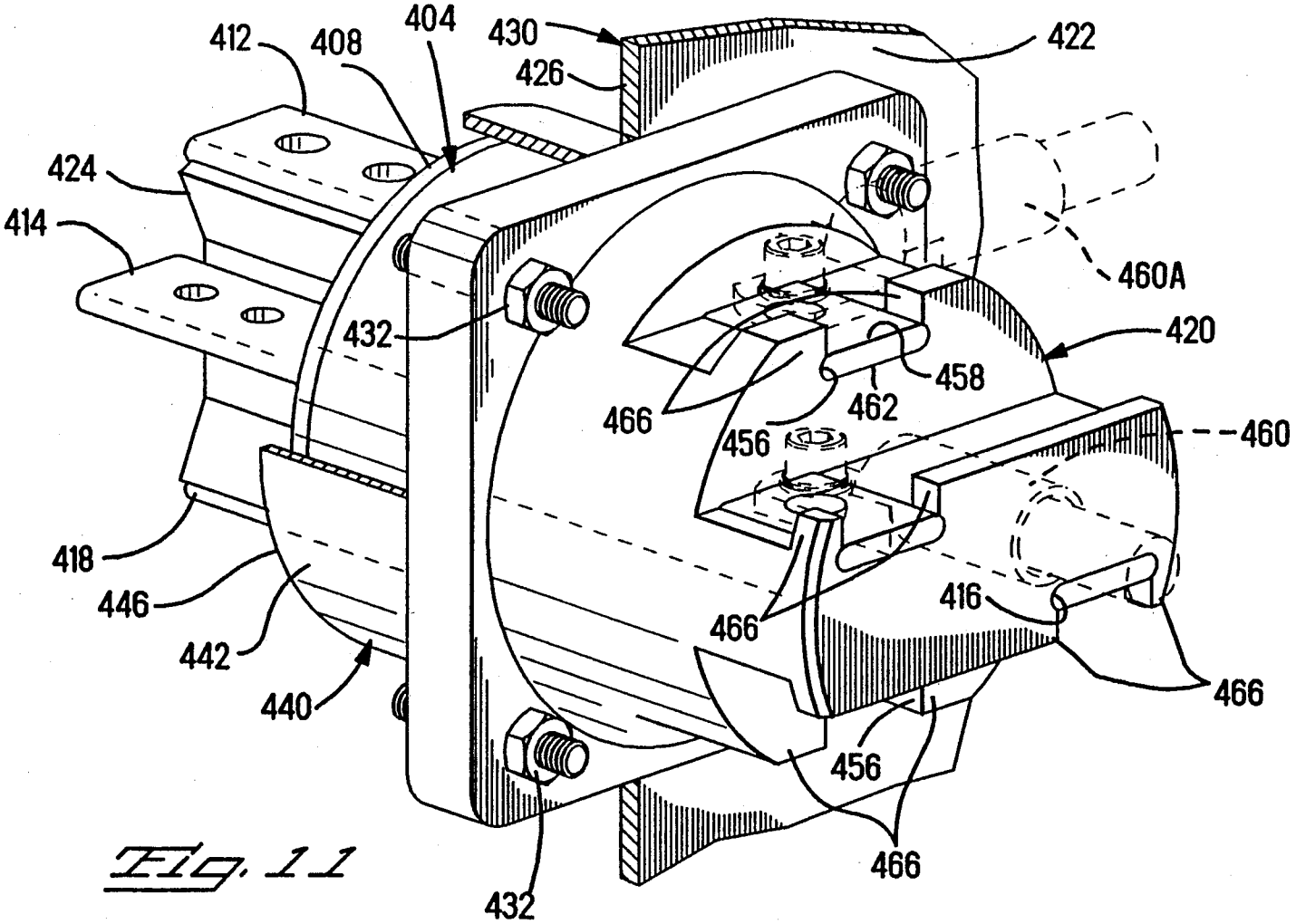
FIGS. 11 and 12 are isometric assembled and exploded views of an additional embodiment of connector including an adapter sleeve mountable within a bulkhead cutout to surround the elastomeric housing.
Figure 12:
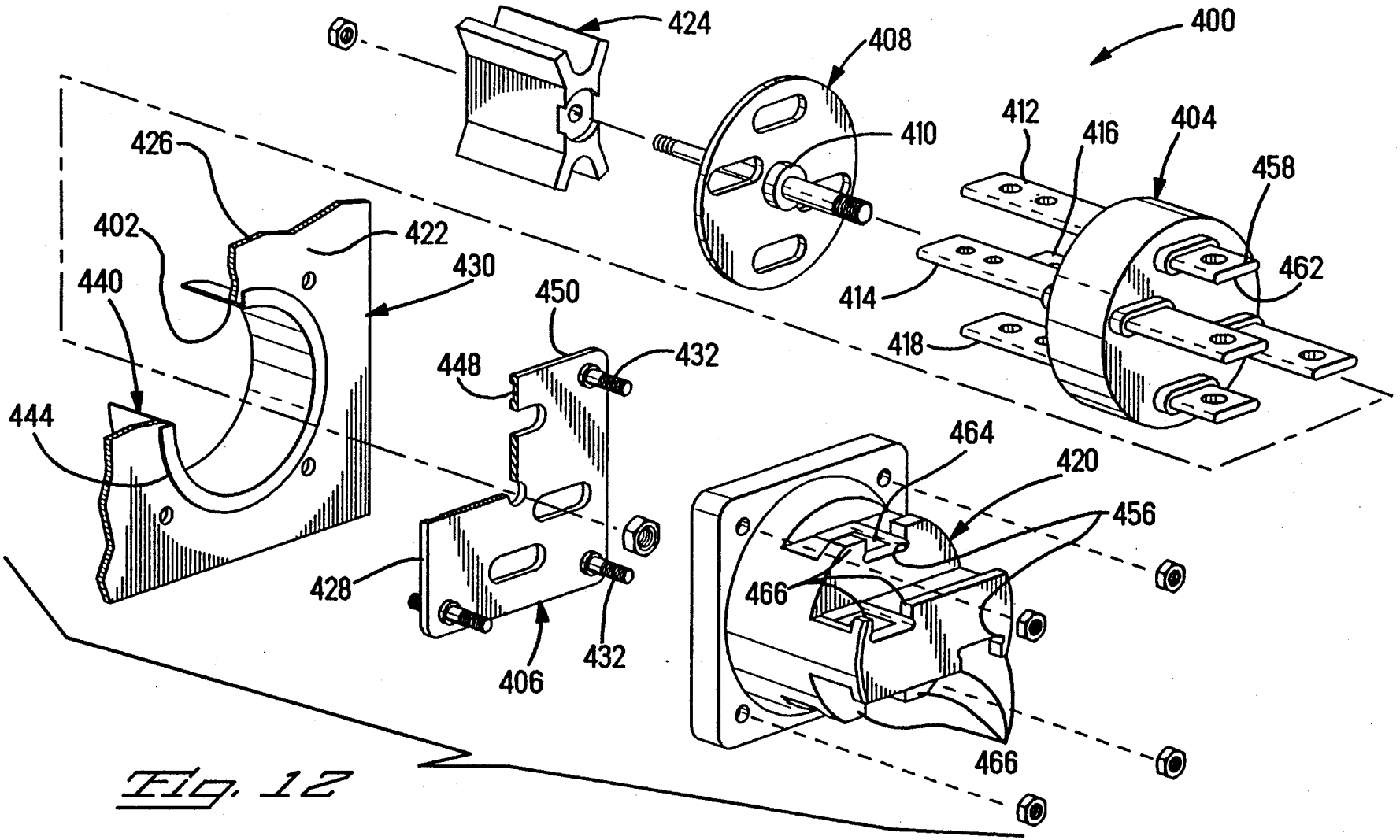

FIGS. 11 and 12 illustrate an additional embodiment of connector 400 useful for bulkhead openings 402 not having an annular sleeve already integrally joined thereto. Connector 400 includes an elastomeric member 404, first and second metal plates 406,408 securable to ends thereof by stud assembly 410, bus bars 412,414,416,418 extending therethrough, first housing member 420 fastened to first plate 406 on engine side 422, and second housing member 424 fastened against second plate 408 on ship side 426. First metal plate 406 includes a mounting flange 428 mountable to bulkhead 430 by fasteners 432 against engine side 422 thereof. Connector 400 also includes an adapter sleeve 440 such as of stainless steel assembled thereto having a cylindrical body portion 442 to extend from an annular flange 444 along and surround elastomeric member 404 to an end 446. First metal plate 406 includes a recess 448 into bulkhead-adjacent surface 450 thereof within which annular flange 444 is seated upon assembly, so that annular flange 444 abuts the surface of the engine side of bulkhead 430. Bus bars 412 and 418 can be said to be outer ones of an array, and bus bars 414,416 inner ones of the array, where the bus bars are oriented with their first and second major surfaces coparallel with each other. Sufficient dielectric material is provided between the portions of the bus bars closest to each other, at side or minor surfaces thereof.

First housing member 420 includes portions 450,452 extending from end face 454 which include channels 456 thereinto within which are seated ends of the respective bus bars, with first major surfaces 458 of contact sections thereof exposed for fastening of cable terminals 460,460A thereto (shown in phantom), and second major surfaces 462 overlying female inserts 464 within pockets beneath channels 456 as in FIG. 6. Pairs of embossments 466 are disposed at ends of channels 456 extending past first and second minor surfaces 468 of the bus bars and outwardly of exposed first major surfaces 458 thereof, spaced apart a distance just wide enough to permit fastening of a cable terminal 460 onto first major surface 458 between the pair of embossments which is no larger than a certain size appropriate for that current-carrying capability for which bus bars 412,414,416,418 are suited because of the cross-section thereof. Thus larger terminals for greater current-carrying cables cannot be fastened to the bus bars of the connector. Similarly the pairs of embossments 466 are spaced a like distance from the adjacent end surface portion of first housing member 420 to permit fastening of a cable terminal 460A at right angles, and in either direction, and similarly prevent oversize terminals from being fastened.

The present invention provides an integral fire stopping means within the connector, which provides a barrier closing the bulkhead opening in which the connector is mounted, to protect the ship side of the bulkhead from flame in the event of a fire on the engine side. The fire stopping means has been shown in two embodiments for being positively mounted to the bulkhead within a cylindrical flange thereof, and in an additional embodiment containing an adapter sleeve securable within the connector to extend through a bulkhead opening of appropriate dimension, thereby being suited for retrofitting a variety of previous bulkhead opening arrangements or for entirely new installations. The connector is particularly suited for interconnection of power cables in a high temperature in-service environment.

Other variations and modifications may occur which are in the spirit of the invention and the scope of the claims. The bulkhead connector of the present invention may be used for electrical connections through bulkheads in other structures such as ships or buildings, wherein fire hazards are of particular concern. The contact sections of the bus bars could be formed into other configurations suitable to being electrically connected with other types of complementary terminals.

We claim:

1. An electrical connector adapted for bulkhead mounting, for extending through a bulkhead opening of the type having a cylindrical flange extending axially therefrom and joined to the bulkhead, and interconnecting associated cables on opposed sides of a bulkhead, comprising:

at least one bus bar having a body section extending between first and second contact sections at first and second ends thereof;

an elastomeric member disposed within said cylindrical flange of said bulkhead and including an aperture therethrough associated with each said bus bar, with said body section of a respective said bus bar extending therethrough with said first and second contact sections extending outwardly of ends of said elastomeric member to be at least exposed for electrical connection to respective ends of associated electrical cables;

said elastomeric member being secured between first and second metal plates having corresponding bar-receiving apertures through which extend a respective said bus bar, said first and second metal plates being mechanically fastened by a stud assembly actuatable to draw said first and second plates toward each other compressing said elastomeric member and deforming the elastomeric material thereof tightly around said body section of each said bus bar and against an inside surface of said cylindrical flange and closing gaps at said bar-receiving apertures through said first and metal plates, whereby a connector is defined permitting electrical cables on opposing sides of a bulkhead to be disconnectably joined electrically while providing a flame barrier across said bulkhead opening.

2. The electrical connector as set forth in claim 1 further including first and second housing portions adjacent said first and second metal plates and adjacent ends of said at least one bus bar and insulating said body section thereof while at least exposing said first and second contact sections of each said bus bar for electrical connection to said cables.

3. The electrical connector as set forth in claim 1 wherein said elastomeric member includes bar-sealing flange portions extending through said first and second bar-receiving apertures of said first and second metal plates.

4. The electrical connector as set forth in claim 1 wherein each said bar-receiving aperture through said elastomeric member is initially slightly larger than the cross-section of said body section of said bus bar extending therethrough.

5. The electrical connector as set forth in claim 2 wherein said first housing portion includes a flange portion having a recess receiving said second plate thereinto.

6. The electrical connector as set forth in claim 2 wherein said second housing member underlies said second contact section of each said bus bar respectively and include female inserts thereunder and thereagainst having threaded apertures thereinto aligned with bolt-receiving holes through said second contact section, enabling ring terminals to be secured and electrically connected to said second contact sections by terminal bolts extending through holes in said ring terminals and through said bolt-receiving holes and threaded into said threaded apertures of said female inserts, said female inserts thus being held by said second housing members against rotation.

7. The electrical connector as set forth in claim 1 wherein one of said first and second metal plates includes a mounting flange coextending along a surface of said bulkhead adjacent said opening therethrough for being fastened to said bulkhead.

8. An electrical connector adapted for bulkhead mounting, for extending through a bulkhead opening and interconnecting associated cables on opposed sides of the bulkhead, comprising:

at least one bus bar having a body section extending between first and second contact sections at first and second ends thereof;

an elastomeric member including an aperture therethrough associated with each said bus bar, with said body section of a respective said bus bar extending therethrough with said first and second contact sections extending outwardly of ends of said elastomeric member to be at least exposed for electrical connection to respective ends of associated electrical cables;

a cylindrical metal sleeve surrounding said elastomeric member and extending outwardly from said bulkhead and including an annular flange adapted to abut the surface of said bulkhead peripherally surrounding said opening;

said elastomeric member being secured between first and second metal plates having corresponding bar-receiving apertures through which extend a respective said bus bar, said first and second metal plates being mechanically fastened by a stud assembly actuatable to draw said first and second plates toward each other compressing said elastomeric member and deforming the elastomeric material thereof tightly around said body section of each said bus bar and against an inside surface of said cylindrical sleeve and closing gaps at said bar-receiving apertures through said first and metal plates, whereby a connector is defined permitting electrical cables on opposing sides of a bulkhead to be disconnectably joined electrically while providing a flame barrier across said bulkhead opening.

9. The electrical connector as set forth in claim 8 wherein one of said first and second metal plates includes a mounting flange coextending along a surface of said bulkhead adjacent said opening therethrough for being fastened to said bulkhead and said annular flange of said cylindrical sleeve is disposed within a corresponding recess into a bulkhead adjacent surface of said one of said first and second metal plates.

10. The electrical connector as set forth in claim 8 further including at least one housing member adjacent one of said first and second metal plates and adjacent ends of each said bus bar thereat and insulating said body section thereof while at least exposing a surface of a corresponding one of said first and second contact sections of each said bus bar for electrical connection to said cables.

11. The electrical connector as set forth in claim 10 wherein said at least one housing member includes portions extending from an end face thereof underlying and supporting said contact section of each said bus bar opposed from said exposed surface thereof.

12. The electrical connector as set forth in claim 11 having at least four said bus bars wherein said bus bars are rectangular and have first and second major surfaces and minor surfaces with said contact sections adapted for fastening of a said cable terminal against a said first major surface thereof, and said bus bars are oriented with major surfaces being coparallel and define an array having relatively outer and inner ones of said bus bars, and each said portion extending from said end face thereof supports a respective said bus bar contact section along a said second major surface of said bus bar, said portions supporting said contact sections of said inner ones thereof extending farther outwardly than said portions supporting said contact sections of said outer ones, whereby said housing member provides access to all said first major surfaces of said contact sections for fastening respective said cable terminals thereto.

13. The electrical connector as set forth in claim 12 wherein each said portion supporting a said contact section includes a pair of embossments extending beside minor surfaces of each said bus bar contact section beyond said exposed surface thereof defining a space of selected dimension therebetween permitting terminals to be inserted therebetween and against said contact section exposed surface having a width less than said dimension of said space between said pair of embossments.

14. The electrical connector as set forth in claim 13 wherein said pair of embossments are spaced from transverse surface portions of said housing member a distance equal to said dimension of said space between said pair of embossments, defining a clearance permitting fastening of said cable terminal at right angles to said bus bar in either of two opposing directions.

* * * * *